US007242314B2

(12) United States Patent
Fisler

(10) Patent No.: US 7,242,314 B2
(45) Date of Patent: Jul. 10, 2007

(54) STROBE UNIT WITH CURRENT LIMITER

(75) Inventor: Charles F. Fisler, Sycamore, IL (US)

(73) Assignee: Honeywell International, Inc., Morristown, NJ (US)

( * ) Notice: Subject to any disclaimer, the term of this patent is extended or adjusted under 35 U.S.C. 154(b) by 235 days.

(21) Appl. No.: 10/714,707

(22) Filed: Nov. 17, 2003

(65) Prior Publication Data

US 2005/0104739 A1 May 19, 2005

(51) Int. Cl.
*G08B 5/00* (2006.01)

(52) U.S. Cl. ..... 340/815.4; 340/331

(58) Field of Classification Search ..... 315/219, 315/241 S, 200 A, 241 R, 185 R; 340/293, 340/331, 288, 333
See application file for complete search history.

(56) References Cited

U.S. PATENT DOCUMENTS 5,121,033 A * 6/1992 Kosich ..... 315/241 R
6,049,446 A * 4/2000 Ha et al. ..... 361/58
6,242,872 B1 * 6/2001 Ha ..... 315/293
6,556,132 B1 * 4/2003 Pattok et al. ..... 340/331
6,661,337 B2 * 12/2003 Ha et al. ..... 340/293
6,819,059 B2 * 11/2004 Block et al. ..... 315/241 S
6,822,400 B1 * 11/2004 Ha et al. ..... 315/241 S
6,828,803 B2 * 12/2004 Ichimasa et al. ..... 324/678
6,897,772 B1 * 5/2005 Scheffler et al. ..... 340/506
2002/0125840 A1 9/2002 Ha et al.
2005/0035851 A1 * 2/2005 Keeney et al. ..... 340/331

* cited by examiner

*Primary Examiner*—Shih-Chao Chen
*Assistant Examiner*—Minh Dieu A
(74) *Attorney, Agent, or Firm*—Welsh & Katz, Ltd.

(57) ABSTRACT

A variable output strobe unit includes a variable current limiting circuit to limit peak current draw after each flash. Parameters of strobe output and current limiting circuit are related and can be set manually or electronically.

37 Claims, 6 Drawing Sheets

STROBE UNIT WITH CURRENT LIMITER

FIELD OF THE INVENTION

The invention pertains to alarm indicating output devices. More particularly, the invention pertains to such devices which emit visual outputs on a periodic basis while limiting peak current requirements.

BACKGROUND

Strobe units are often used as visual alarm indicating output devices in fire alarm systems. As is known, such units emit a high intensity light periodically, for example once a second, to provide an ongoing indication that an alarm condition has been detected somewhere in the region being monitored. One such unit has been disclosed in U.S. patent application Ser. No. 10/040,968 filed Jan. 2, 2002 for Processor Based Strobe with Feedback assigned to the Assignee hereof and incorporated by reference herein.

Known units include an energy storage device, for example one or more capacitors, coupled to a gas discharge tube. When the tube is triggered with an appropriate control signal it emits high intensity light while discharging the storage device.

Known strobe units exhibit maximum peak current values subsequent to discharge of the storage element when the tube is triggered. The peak or surge current is primarily due to the fact that electrolytic capacitors in the device need to be recharged for the next flash.

FIG. 1 illustrates a representative timing diagram of peak capacitor recharge current values $I_{REP}$. These peak current values are of a type exhibited by known strobe units each time the gas filled tube is triggered. At startup, a substantially larger initial current surge $I_0$, which might be as large as 10 amps is exhibited by known units. In contrast, the peak repeating current values $I_{REP}$ fall in a range of 5 to 7 amps. In contradistinction, the steady state $I_{RMS}$ current typically falls in range of 50 milliamps to 800 milliamps.

It is also known that the magnitudes of the peak initial current surge $I_0$ as well as the repetitive peak current values $I_{REP}$ vary continuously, from one second to the next, in response to discharge characteristics of the capacitors, the form of electrical energy being supplied to the unit as well as the phase thereof.

In view of the fact that the initial peak current draw $I_0$ as well as the repetitive peak current draw $I_{REP}$ are exhibited by each of the strobe devices in the system it would be desirable to be able to limit not only the initial peak current surge but also the repetitive ongoing current surges as the unit flashes. Preferably, limiting the amplitudes of the peak current surges can be done without affecting the ability of the units to recharge adequately during the available one-second period to provide the next flash of light. Additionally, it would be desirable if peak current limiting could be achieved without substantial increase in heat generated by the respective strobe units or without substantially increasing the size, cost or manufacturing complexity of such units.

DETAILED DESCRIPTION OF THE PREFERRED EMBODIMENTS

Figure 1:
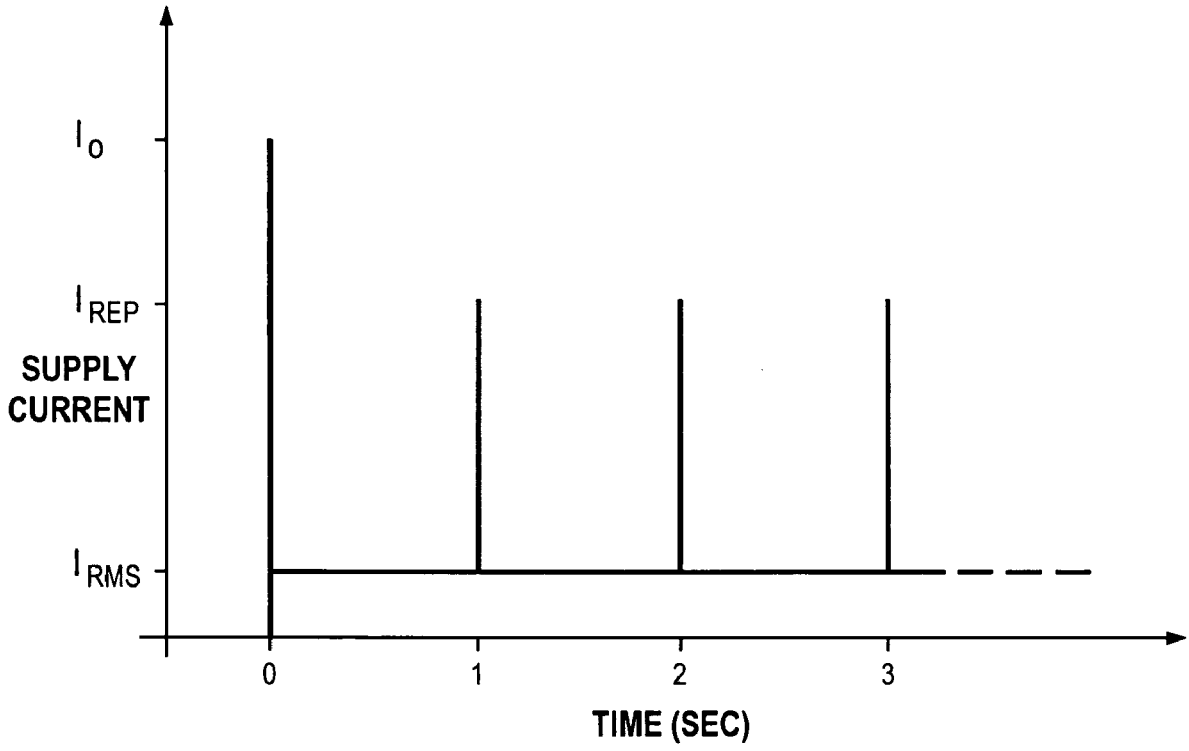
FIG. 1 PRIOR ART
FIG. 1 is a graph illustrating current draw characteristics of an exemplary prior art strobe unit.

While this invention is susceptible of an embodiment in many different forms, there are shown in the drawing and will be described herein in detail specific embodiments thereof with the understanding that the present disclosure is to be considered as an exemplification of the principals of the invention. It is not intended to limit the invention to the specific illustrated embodiments.

Figure 2:
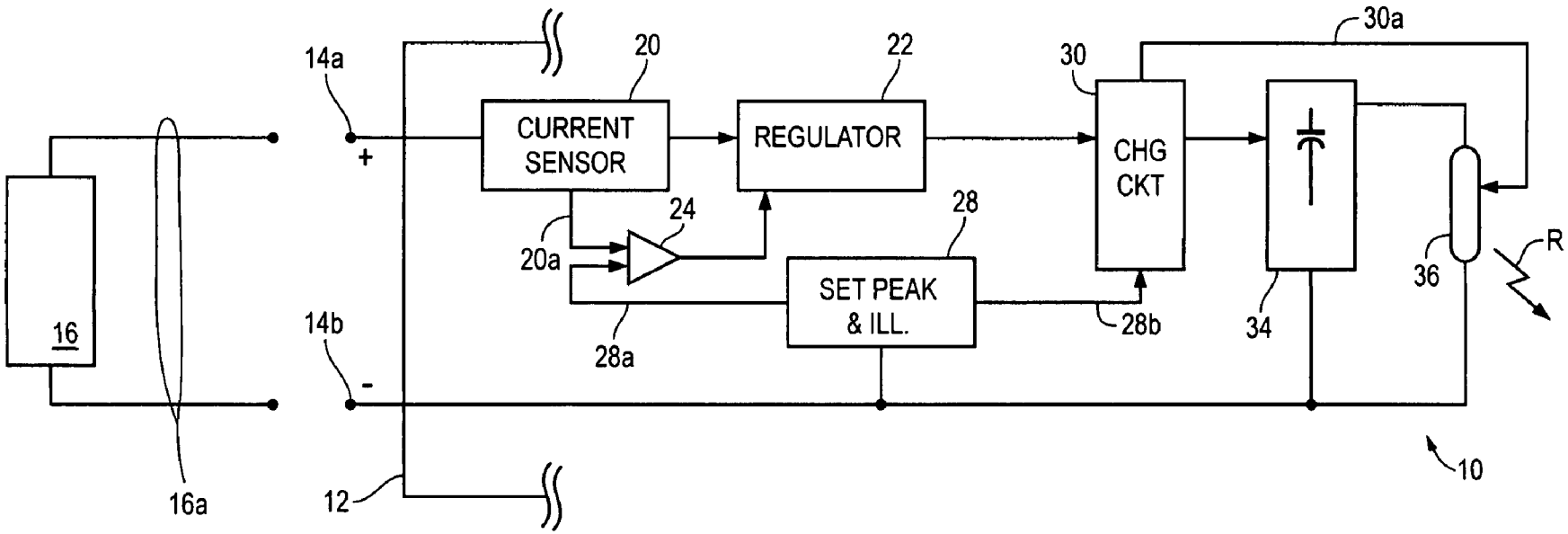
FIG. 2 is a block diagram of a strobe unit in accordance with the invention.

FIG. 2 illustrates a device 10 in accordance with the present invention. Device 10, which in exemplary form is illustrated as a warning or emergency indicating strobe unit as an exemplary application only, incorporates a housing 12 and at least a pair of input terminals 14*a,b*.

The input terminals 14*a, b* receive electrical energy and/or control signals from a remote switchable source 16. For example and without limitation, source 16 could provide a reversible 5 to 24 volt input to terminals 14*a, b* to energize and control the device 10. In a first mode, the power supply 16 could apply a negative 5 volts between the terminals 14*a, b* which would be a nonoperational condition but could be used for supervision purposes.

To activate the device 10, the source 16 could reverse polarity and couple a plus 24 volts across the terminals 14*a, b* along with embedded control signals as desired. Those of skill in the art will understand how such systems work in general in connection with warning or alarm indicating output devices wherein a device such as the device 10 could be used.

Device 10 further includes a current sensor 20 coupled to a current regulator 22. An output from the current sensor 20 is also coupled to a comparator 24. A second input to the comparator 24 is received from a set peak current and illumination level element 28. Both the current regulator 22 and the illumination parameter setting element 28 are coupled to charging circuitry 30.

The charging circuitry 30 is in turn coupled to one or more energy storage devices, such as capacitors and/or inductors or the like, 34 as would be understood by those skilled in the art. The energy storage devices 34 are in turn coupled to a gas filled member or tube 36.

As is conventional in the art, the tube or member 36 can be energized with energy stored in devices 34 and triggered by charging circuit 30, trigger line 30*a*. When triggered, a device 36, due to ionized gases therein, emits an intense radiant energy output R while discharging the energy storage devices 34.

The process of recharging the energy storage devices 34 causes a greater than normal current draw via terminals 14*a, b*. A peak value of this current draw can be limited in device 10 as a result of an output 20*a* of current sensor 20 moving away from a set point established by the set peak current element 28, line 28*a*. This difference, via comparator 24 is coupled to regulator 22 which in turn increases an input impedance of the device 10 thereby limiting the peak value of recharge or surge current of the device 10.

Figure 3:
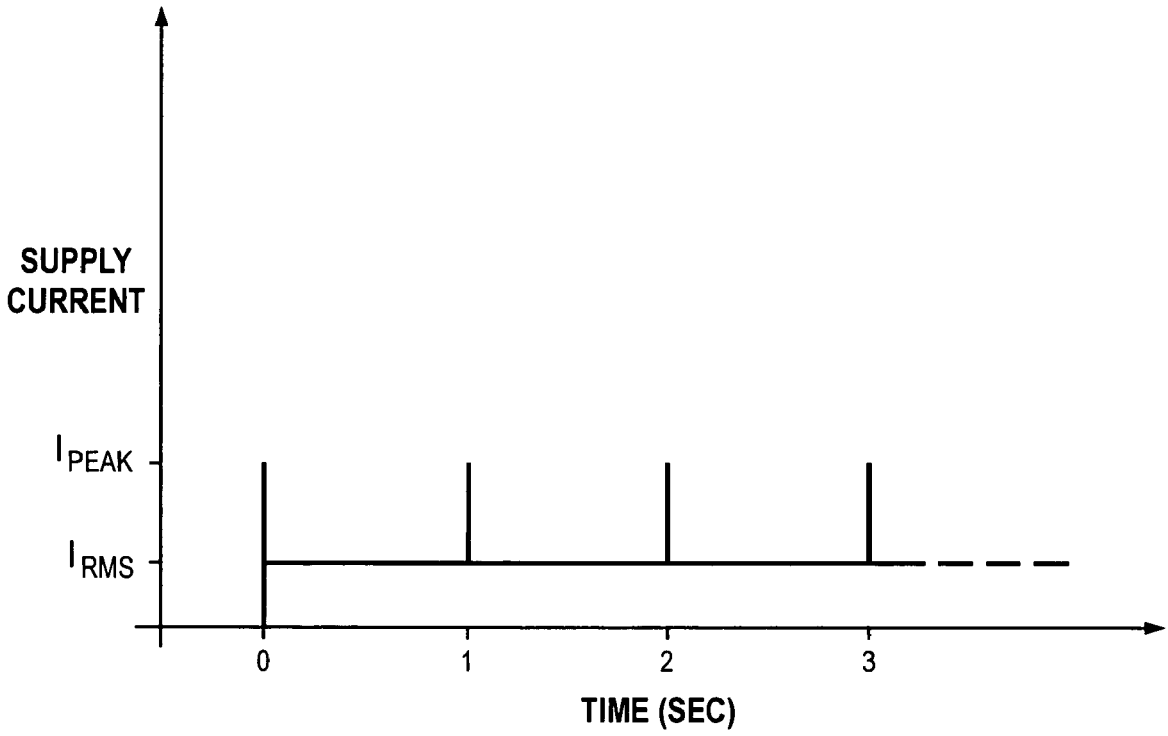
FIG. 3 is a graph illustrating reduced peak current draw of the unit of FIG. 2.

FIG. 3 illustrates a reduced value of peak recharge current achievable with device 10. FIG. 3 is plotted on the same scale and time base as is FIG. 1. As is apparent from a comparison of FIGS. 1 and 3, device 10 with the current sensor 20 and comparator 24 providing control inputs to current regulator 22 exhibits a substantial reduction in peak surge current.

The peak repeating surge current $I_{REP}$ of FIG. 1 can be reduced from a range of 5 to 7 amps for example to a selectable range based on the type of application and imposed maximum, surge current values as illustrated in FIG. 3.

Figure 4:
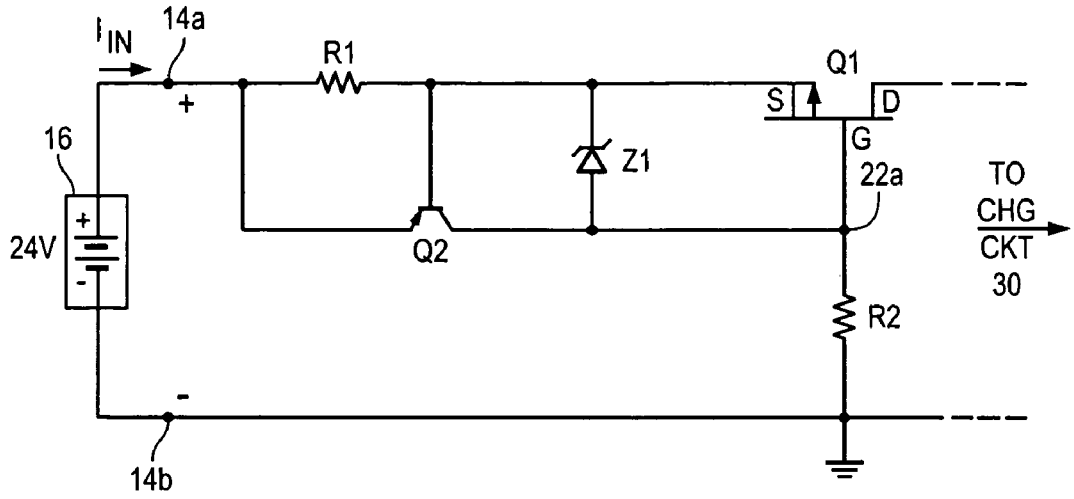
FIG. 4 is a partial schematic diagram of one embodiment of the strobe unit of FIG. 2.

FIG. 4 illustrates in more detail an exemplary embodiment of current sensor 20, regulator 22 and comparator 24 configured to limit peak surge current in a device such as warning or alarm device 10. As illustrated in FIG. 4, current sensor 20 can be implemented with resistor R1. Comparator 24 can be implemented using transistor Q2. Regulator 22 can be implemented using field effect transistor Q1, a Zener diode Z1 and resistor R2. An output from the drain D of regulator transistor Q1 is in turn coupled to charging circuit 30.

In a normal operating condition, between flashes, where source 16 is applying a positive 24 volt potential to terminals 14*a, b* as illustrated in FIG. 4, Zener diode Z1 in combination with resistor R2 establish a bias for regulator transistor Q1 resulting in an input current $I_{IN}$ corresponding to the steady state current $I_{RMS}$ illustrated in FIGS. 1 and 3. In this condition transistor Q2 is biased off.

The drop across resistor R1 in combination with current $I_{RMS}$ is insufficient to turn on transistor Q2. Current limiting becomes effective when transistor Q2 turns on. This will occur when the drop across resistor, R1 substantially equals or slightly exceeds the voltage necessary to forward bias base-emitter junction of transistor Q2 which will be on the order of about 0.6 volts. This will take place when the current $I_{IN}$ increases toward $I_{PEAK}$ in response to needing to recharge the energy storage devices 34.

As $I_{IN}$ increases, transistor Q2 conducts which in turn raises the gate voltage at node 22*a*. Increasing the gate voltage at node 22*a* reduces the magnitude of the gate-to-source voltage of transistor Q1 which in turn reduces current flow through Q1.

A circuit as in FIG. 4 can be incorporated into device 10 to limit peak surge currents, as in FIG. 3, where only a single candela output is desired from device 10.

Figure 5:
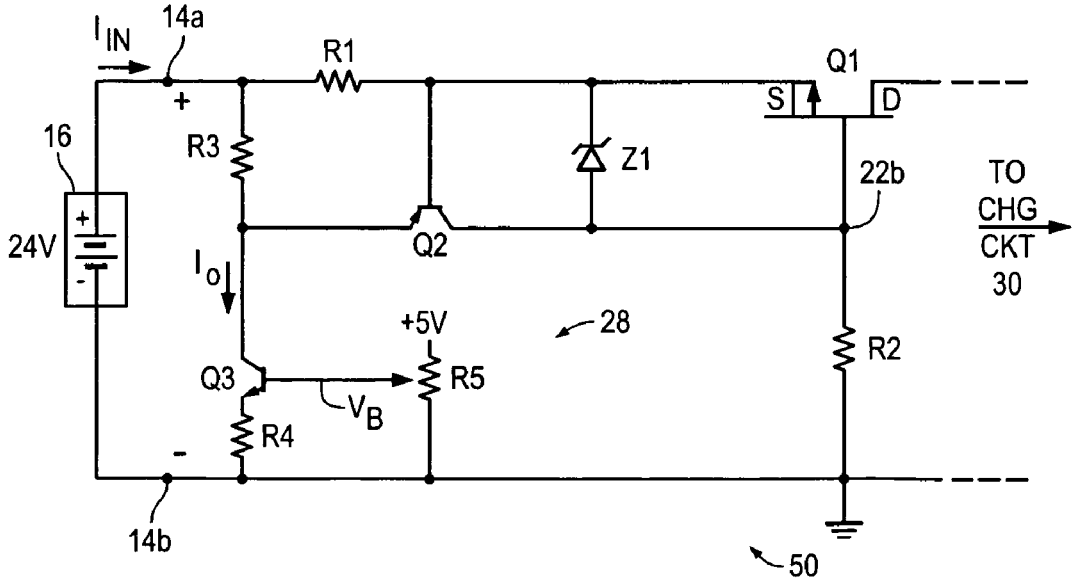
FIG. 5 is a partial schematic diagram of another embodiment of the strobe unit of FIG. 2.

FIG. 5 illustrates variable input circuitry 50 usable in device 10. Circuit 50 would in turn be coupled to charging circuit 30. Structural elements common to the circuit of FIG. 4 and the circuit of FIG. 5 have been assigned the same identifiers.

Circuitry 50 includes potentiometer R5 which provides a manually or electrically adjustable analog input, voltage $V_B$ which can be varied to adjust the peak value of the surge current $I_{PEAK}$ which occurs as the energy storage elements 34 are recharged each time the tube 36 is flashed. Voltage $V_B$ is used to adjust and vary current $I_0$ via a transistor Q3.

In the configuration 50 of FIG. 5, the turn-on point for transistor Q2 corresponds to the voltage drop across resistor R3 plus the base emitter voltage of transistor Q2. In this regard, the transistor Q3, resistor R4 and resistor R5 in combination form a variable current source for the current $I_0$. Hence, by adjusting resistor R5 the current $I_0$ can be adjusted which in turn alters the voltage across resistor R3 and the turn on point for transistor Q2. Table 1 illustrates exemplary peak values of input current $I_{IN}$ for configuration 50 for various values of $V_B$. Those of skill in the art will understand that $I_{PEAK}$ can be varied based on values chosen for R1, R3 and R4.

TABLE 1

| $V_B$ (Volts) | $I_{PEAK}$ (mA) |
|---|---|
| 0 | 200 |
| 1 | 300 |
| 2 | 500 |
| 3 | 700 |
| 4 | 900 |
| 5 | 1100 |

It will be understood that a variety of circuit configurations could be used to implement a system having a block diagram of the system 10 all without departing from the spirit and scope of the present invention. Similarly, neither specific semiconductor types nor specific component values represent a limitation of the present invention. Those with skill will understand that where the device 10 is intended to provide a multi candela output, the circuit 50 would be adjusted to an appropriate peak current value in accordance with a desired candela output.

Figure 6:
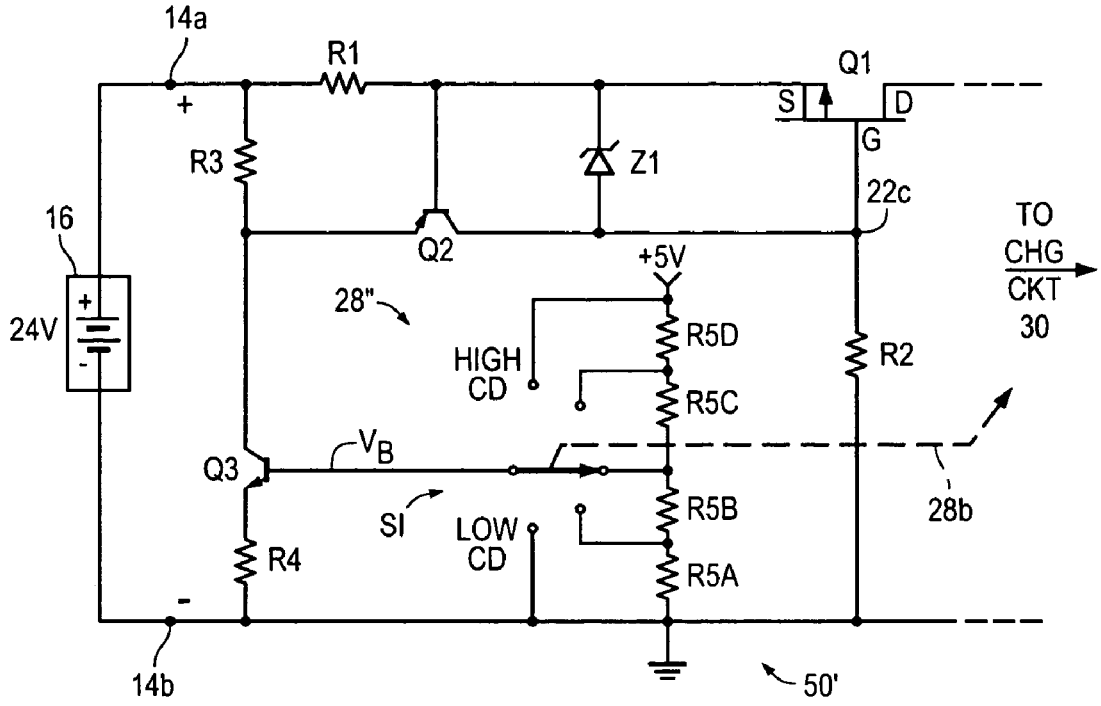
FIG. 6 is a partial schematic diagram of another embodiment of the strobe unit of FIG. 2.

FIG. 6 illustrates a circuit configuration 50' with a plurality of different peak surge currents selectable via a mechanical or electrical switch indicated generally at S1. Switch S1 sets the voltage $V_B$ to provide the selected maximum surge current. Via a line 28*b* indicated in phantom, that setting is also coupled to charging circuit 30 to set the selected respective candela output from member 36. Hence, switch S1 enables an installer to simultaneously set the desired output candela as well as limit the surge current to a predetermined maximum associated with the selected candela output.

Where appropriate, the circuitry 50' can be used to limit initial surge current $I_0$ to be less than or equal to 10 times the average current $I_{RMS}$ the unit 10 draws. Additionally, the peak surge current $I_P$ can be limited so that it is not greater than 5 times the average current draw by the unit 10, $I_{RMS}$, between output pulses.

Figure 7:
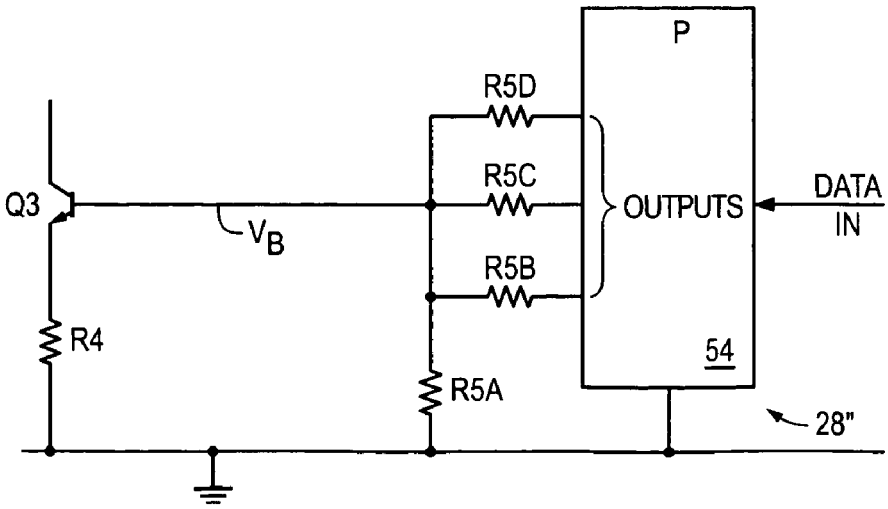
FIG. 7 is a partial schematic diagram of yet another embodiment of the strobe unit of FIG. 2.

FIG. 7 illustrates yet another embodiment of a circuit 50" which incorporates a programmed processor 54 in combination with the plurality of resistors R5A . . . R5D to set the voltage $V_B$. Those with skill will understand that data provided to the processor 54 can in turn cause that processor to select one or more of the resistors R5B . . . R5D alone or in combination so as, via transistor Q3, to set the peak surge current for the unit 10 as discussed above.

It will be understood that neither the exact form of current sensor 20 nor comparator 24 are limitations of the present invention.

Figure 8:
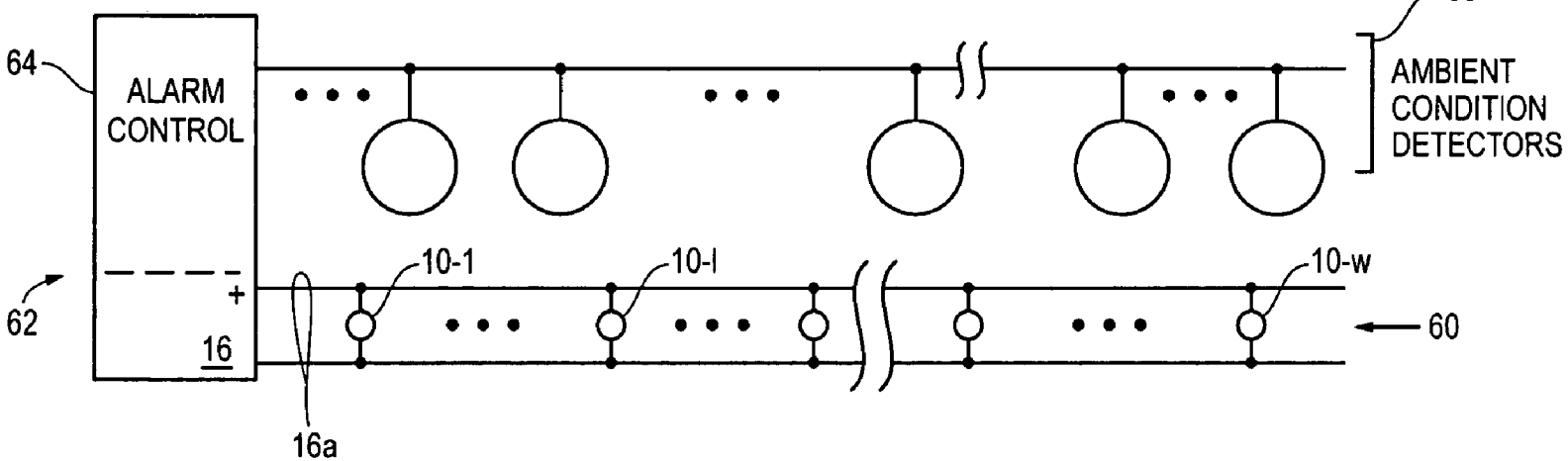
FIG. 8 is a system of strobe units as in FIG. 2.

As illustrated in FIG. 8 a plurality 60 of units 10 such as 10-1,-2 . . . -*w* could be driven via switchable source 16 through a wire medium, such as medium 16*a* as might be used in a monitoring or alarm system 62. Such systems have been disclosed and claimed in U.S. Pat. No. 5,598,139 for fire detecting system synchronized strobe lights and U.S. Pat. No. 5,850,178 for alarm system having synchronizing pulse generator and synchronizing pulse motion detector both of which were assigned to the Assignee hereof and incorporated by reference herein.

Those of skill will understand that alarm control circuits 64, in response to alarm indicating signals from detectors 66 could cause supply 16 to switch from −5 volts applied to medium 16*a*, strobe units inactive, to plus 24 volts to activate strobes 60. In such systems, current limiters, as described above are especially advantageous in that they minimize peak surge currents produced by numerous strobe units 10 triggering and recharging at the same time.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A visual output device comprising:

an energy input port;

a current limiter coupled to the input port;

a strobe circuit coupled to the current limiter with the current limiter responsive to a strobe circuit flash condition to reduce a post-flash peak current draw of the strobe circuit below a preselected value.

2. An output device as in claim 1 where the strobe circuit comprises a passive energy storage device coupled to a gas filled member.

3. An output device as in claim 2 where the current limiter comprises a current sensor and an electronic switch with a control output coupled to the strobe circuit.

4. An output device as in claim 3 where the electronic switch comprises a transistor.

5. An output device as in claim 4 which includes a manually settable, current limiter selection element.

6. A visual output device comprising:

an energy input port;

a current limiter coupled to the input port;

a strobe circuit coupled to the current limiter with the current limiter responsive to a strobe circuit flash condition to reduce a post-flash peak current draw of the strobe circuit below a settable post-flash peak current value and which includes a control input port for varying at least one parameter of the current limiter in accordance with a selected visual output parameter to thereby set the post-flash peak current value.

7. An output device as in claim 6 where the at least one parameter comprises a control voltage.

8. An output device as in claim 6 which includes at least one of, a manually selectable visual output parameter, or, an electronically selectable visual output parameter.

9. An output device as in claim 8 which includes a manually settable element to select the visual output parameter and to select a current limiter parameter.

10. An output device as in claim 9 where the manually settable element comprises at least one of a mechanical switch, or an electronic switch.

11. An output device as in claim 8 which includes an electrically settable element to select the visual output parameter and to select a current limiter parameter.

12. An output device as in claim 6 which includes at least one of a movable current limiter parameter specifying element, or a non-movable current limiter parameter specifying element.

13. A visual output device comprising:

an energy input port;

a current limiter coupled to the input port;

a strobe circuit coupled to the current limiter with the current limiter responsive to a strobe circuit flash condition to reduce a post-flash peak current draw of the strobe circuit below a selected, variable peak current value and which includes a manual adjustment element coupled to the current limiter, and, to the strobe circuit, the adjustment element varying both a current limiting parameter of the current limiter, and a visual output parameter of the strobe circuit to thereby select a respective post-flash peak current value.

14. A system comprising:

a plurality of visual output devices, each of the devices includes a control element, the control element includes a programmed processor that is one of, mechanically or electrically settable, the control element limits a peak current draw of the respective device in accordance with a selected one of a plurality of output illumination parameters; and a switchable source of electrical energy to power the devices.

15. A system as in claim 14 where the output devices each includes a triggerable light emitting output device.

16. A system as in claim 15 where the light emitting output device comprises a gas filled member.

17. A system as in claim 14 where the control element in each of the devices limits a peak repetitive current draw in accordance with a setting thereof.

18. A system as in claim 17 where the peak repetitive current draws occur subsequent to the source switching to an energy supplying state.

19. An illuminatable unit comprising:

a visual output element;

a source of energy to intermittently illuminate the element;

a control circuit coupled to the source of energy;

a current limiting circuit, coupled to the control circuit, to limit a post-illumination maximum current draw as a function of a selectable output illumination parameter; and circuitry which includes a programmed processor to adjust the current limiting circuit in response to selecting one of a plurality of illumination parameters.

20. A unit as in claim 19 where the visual output element comprises a flashable gas filled member, and the current limiting circuit limits a peak charging current associated with the member.

21. A unit as in claim 19 where both the current limiting circuit and the control circuit are adjusted together in response to selecting one of a plurality of output illumination parameters.

22. A unit as in claim 21 with the circuitry to adjust including at least one of a manually manipulatable element, or, an electronically manipulatable element.

23. A unit as in claim 22 where the manually manipulatable element, is one of linearly movable, rotatably movable, or, removable at least in part to select the one illumination parameter.

24. A device as in claim 23 where the manually manipulatable element is coupled to the current limiting circuit to limit current draw in accordance therewith.

25. A unit as in claim 19 with the circuitry to adjust including at least one of a manually manipulatable element, or, an electronically manipulatable element.

26. A unit as in claim 19 where maximum current draw is limited, subsequent to the element being illuminated, to a value associated with a selected illumination parameter.

27. A unit as in claim 19 where the source of energy comprises a capacitor.

28. A unit as in claim 27 which includes a housing, the housing carries the visual output element, the capacitor, the control circuit and the current limiting circuit.

29. A unit as in claim 28 where the housing carries a manually manipulatable control member to select an illumination parameter.

30. A unit as in claim 29 where the control member comprises one of linearly movable, rotatably movable or removable at least in part to specify the illumination parameter.

31. A unit as in claim 30 where the control member comprises a switch.

32. An illuminatable unit comprising:

a visual output element;

a source of energy to illuminate the element;

a control circuit coupled to the source of energy; and a current limiting circuit, coupled to the control circuit, to limit maximum current draw as a function of a selectable output illumination parameter and which includes a current sensor coupled to a comparator, the comparator establishing at least one peak current value.

33. A unit as in claim 32 with the comparator including circuitry for establishing a plurality of peak current values.

34. A unit as in claim 33 which includes an adjustable electrical parameter for selecting one of the plurality of peak current values.

35. A system comprising:

a plurality of visual output devices, each of the devices includes a control element which is one of, mechanically movable or electrically settable, to limit a peak current draw of the respective device in accordance with a selected one of a plurality of output illumination parameters; and a switchable source of electrical energy to power the devices;

where the control element in each of the devices limits a peak repetitive current draw in accordance with a setting thereof; and where each of the output devices exhibits an initial peak current draw when the source switches to an energy supplying state followed by a plurality of spaced apart, repetitive lesser peak current draws, at least the lesser peak current draws are in accordance with a current peak limiting setting of the control element and a different illumination parameter setting which determines an optical output value, from a group thereof.

36. A system as in claim 35 where pairs of peak current limiting and respective different settings are linked.

37. A system as in claim 36 where each of the members of the group of light specifying settings has a peak current limiting setting associated therewith.

* * * * *